US007981965B2

(12) United States Patent
Wu et al.

(10) Patent No.: US 7,981,965 B2
(45) Date of Patent: Jul. 19, 2011

(54) FIBER COMPOSITION AND FIBER MADE FROM THE SAME

(75) Inventors: Ru-Yu Wu, Taoyuan Hsien (TW); Chih-Wei Chu, Taoyuan Hsien (TW); Shih-Hsiung Chen, Taoyuan Hsien (TW); Chao-Yuan Chiang, Taoyuan Hsien (TW)

(73) Assignee: Far Eastern New Century Corporation, Taipei (TW)

( * ) Notice: Subject to any disclaimer, the term of this patent is extended or adjusted under 35 U.S.C. 154(b) by 0 days.

(21) Appl. No.: 12/852,898

(22) Filed: Aug. 9, 2010

(65) Prior Publication Data

US 2010/0324223 A1 Dec. 23, 2010

Related U.S. Application Data

(62) Division of application No. 11/964,333, filed on Dec. 26, 2007, now Pat. No. 7,781,059.

(30) Foreign Application Priority Data

Jan. 12, 2007 (TW) ..... 96101253 A

(51) Int. Cl.
*C08L 33/02* (2006.01)

(52) U.S. Cl. ..... 525/221; 525/50; 525/55; 525/191

(58) Field of Classification Search ..... 525/50, 525/55, 191, 221; 428/373; 524/112; 442/409, 442/361, 364
See application file for complete search history.

(56) References Cited

U.S. PATENT DOCUMENTS

| | | | | |
|---|---|---|---|---|
| 4,789,592 | A | 12/1988 | Taniguchi et al. | |
| 5,206,080 | A | 4/1993 | Tashiro et al. | |
| 5,607,766 | A | 3/1997 | Berger | |
| 5,994,244 | A | 11/1999 | Fujiwara et al. | |
| 6,174,603 | B1 | 1/2001 | Berger | |
| 6,780,367 | B2 | 8/2004 | Pyzik et al. | |
| 7,025,825 | B2 | 4/2006 | Pyzik et al. | |
| 7,518,064 | B2 | 4/2009 | Morioka et al. | |
| 2002/0018895 | A1 | 2/2002 | Pyzik et al. | |
| 2004/0258911 | A1 | 12/2004 | Pyzik et al. | |
| 2005/0148268 | A1 | 7/2005 | Tai | |
| 2007/0160799 | A1 | 7/2007 | Nguyen | |
| 2008/0057309 | A1 | 3/2008 | Liu et al. | |
| 2008/0105454 | A1 | 5/2008 | Morioka et al. | |
| 2008/0260974 | A1 | 10/2008 | Morton-Finger | |
| 2009/0061709 | A1 | 3/2009 | Nakai et al. | |
| 2010/0028661 | A1 * | 2/2010 | Holzmueller et al. | 428/336 |

FOREIGN PATENT DOCUMENTS

| | | | |
|---|---|---|---|
| BE | 869416 A | * | 1/1979 |
| JP | 03133625 | | 6/1991 |
| JP | 03287875 | | 12/1991 |
| JP | 04063817 A | * | 2/1992 |
| JP | 2849929 | | 1/1999 |
| JP | 2851678 | | 1/1999 |

OTHER PUBLICATIONS

Restriction Requirement mailed May 18, 2009 for related U.S. Appl. No. 11/964,333.
Office Action mailed Sep. 4, 2009 for related U.S. Appl. No. 11/964,333.
Notice of Allowance mailed Apr. 14, 2010 for related U.S. Appl. No. 11/964,333.

* cited by examiner

*Primary Examiner* — Cheryl Juska
(74) *Attorney, Agent, or Firm* — Stephen A. Bent; Foley & Lardner LLP

(57) ABSTRACT

A fiber modifier for improving thermo-bonding affinity of a composite fiber to a natural fiber includes a blend of maleic anhydride and a copolymer component selected from a copolymer of ethylene and acrylic acid, a copolymer of ethylene and methacrylic acid, and combinations thereof. A core and sheath composite fiber including a sheath component made from a fiber composition that contains the above fiber modifier is also disclosed.

8 Claims, No Drawings

FIBER COMPOSITION AND FIBER MADE FROM THE SAME

CROSS-REFERENCE TO RELATED APPLICATION

This application is a divisional application of U.S. patent application Ser. No. 11/964,333, filed Dec. 26, 2007 now U.S. Pat. No. 7,781,059, which claims priority of Taiwanese application no. 096101253, filed on Jan. 12, 2007.

BACKGROUND OF THE INVENTION

1. Field of the Invention

This invention relates to a fiber composition, more particularly to a fiber composition including a fiber modifier containing a blend of maleic anhydride and a copolymer component.

2. Description of the Related Art

Disposable hygienic absorbent products, such as disposable diapers, generally include a liquid-permeable surface layer, a liquid-impermeable backsheet, and an absorbent layer interposed between the liquid-permeable surface layer and the liquid-impermeable backsheet. The absorbent layer is typically made from an absorbent material that includes natural fibers such as cellulose fluff pulp fibers, cotton fibers, and rayon fibers, and a super absorbent polymer (SAP). After water is absorbed into the absorbent layer, the absorbent material of the absorbent layer tends to expand and become heavy, and results in an uncomfortable feeling. Thus, in addition to the absorbent material, synthetic fibers are incorporated into the absorbent layer so as to form a supportive structure to fix the absorbent material in place.

The synthetic fibers traditionally used for formation of the supportive structure are thermo-bondable bi-component fibers made from polyolefins, polyesters or combinations thereof. Since these traditional thermo-bondable bi-component fibers have a poor thermo-bonding affinity for the natural fibers, the supportive structure formed by these traditional thermo-bondable bi-component fibers is unable to effectively fix the absorbent material in place. In order to improve adhesion between the thermo-bondable bi-component fibers and the natural fibers, a bi-component fiber disclosed in U.S. Pat. No. 5,981,410 (hereinafter referred to as the '410 patent) has been widely used in the marketplace. Particularly, in the Examples of the '410 patent, the core component of the bi-component fiber is made from polypropylene, and the sheath component of the bi-component fiber includes non-grafted polyethylene and polyethylene grafted with maleic anhydride. The maleic anhydride is used as a modifier for improving the thermo-bonding affinity of the bi-component fiber to natural fibers.

SUMMARY OF THE INVENTION

The object of the present invention is to provide a new and useful fiber modifier for improving thermo-bonding affinity of a composite fiber to a natural fiber.

According to one aspect of this invention, a fiber modifier includes a blend of maleic anhydride and a copolymer component. The copolymer component is selected from the group consisting of a copolymer of ethylene and acrylic acid, a copolymer of ethylene and methacrylic acid, and combinations thereof.

According to another aspect of this invention, a fiber composition includes polyethylene and a fiber modifier. The fiber modifier contains a blend of maleic anhydride and a copolymer component selected from the group consisting of a copolymer of ethylene and acrylic acid, a copolymer of ethylene and methacrylic acid, and combinations thereof.

According to yet another aspect of this invention, a core and sheath composite fiber includes a core component and a sheath component. The sheath component is made from a fiber composition including polyethylene and a fiber modifier. The fiber modifier contains a blend of maleic anhydride and a copolymer component selected from the group consisting of a copolymer of ethylene and acrylic acid, a copolymer of ethylene and methacrylic acid, and combinations thereof.

DETAILED DESCRIPTION OF THE PREFERRED EMBODIMENTS

This invention relates to a fiber modifier for improving thermo-bonding affinity of a composite fiber to a natural fiber. The fiber modifier includes a blend of maleic anhydride and a copolymer component selected from the group consisting of a copolymer of ethylene and acrylic acid, a copolymer of ethylene and methacrylic acid, and combinations thereof.

In one preferred embodiment, the content of maleic anhydride in the blend ranges from 3% to 4% by weight.

In another preferred embodiment, the copolymer component is the copolymer of ethylene and acrylic acid. Preferably, the weight ratio of ethylene to acrylic acid in the copolymer component ranges from 91:9 to 82:18. More preferably, the weight ratio of ethylene to acrylic acid in the copolymer component ranges from 90:10 to 85:15.

The copolymer of ethylene and acrylic acid includes, but is not limited to, Nucrel 2806 (the DuPont Company), PRIMACOR 3460 (the Dow Chemical Company), ESCOR5200 (the ExxonMobil Chemical Company), and the like.

In yet another preferred embodiment, the copolymer component is the copolymer of ethylene and methacrylic acid. Preferably, the weight ratio of ethylene to methacrylic acid in the copolymer component ranges from 96:4 to 85:15. More preferably, the weight ratio of ethylene to methacrylic acid in the copolymer component ranges from 91:9 to 85:15.

The copolymer of ethylene and methacrylic acid includes, but is not limited to, Nucrel 0903 and Nucrel 925 (the DuPont Company), and the like.

In addition, non-limiting examples of the natural fiber that may be used for bonding to the composite fiber includes cellulose fibers, such as cotton fibers, Rayon fibers, and cellulose fluff pulp fibers, viscose fibers, and Lyocell, etc.

The preferred embodiment of a fiber composition according to this invention includes polyethylene and a fiber modifier as described in the preceding paragraphs.

In one preferred embodiment, the weight ratio of polyethylene to the fiber modifier ranges from 95:5 to 88:12. More preferably, the weight ratio of polyethylene to the fiber modifier ranges from 94:6 to 89:11. If the content of the fiber modifier in the fiber composition is higher than 12% by weight, the spinnability of the resulting core and sheath composite fiber is poor. On the other hand, if the content of the fiber modifier in the fiber component is lower than 5% by weight, the thermo-bonding affinity of the resulting core and sheath composite fiber to the natural fiber is not sufficient.

The preferred embodiment of a core and sheath composite fiber according to this invention includes a core component and a sheath component made from a fiber composition as described in the preceding paragraph. In particular, the core component has a melting point higher than that of the sheath component.

Preferably, the sheath component of the core and sheath composite fiber has a melting point ranging from 88° C. to 130° C.

Preferably, the core component having a melting point higher than that of the sheath component may be made from a polymer selected from the group consisting of polypropylene (m.p. about 150° C. to 170° C.), polyamide (m.p. about 210° C. to 260° C.), polylactic acid (m.p. about 150° C. to 170° C.), polyester (m.p. about 200° C. to 255° C.), and combinations thereof.

The core and sheath composite fiber may be produced by melt-spinning techniques, and can be incorporated with the natural fibers to form a non-woven fabric web.

The thermo-bonding affinity of the core and sheath composite fiber according to this invention to the natural fibers will increase with an increase in the content of acryl groups in the fiber modifier. The inventors of the present invention found that the improvement in thermo-bonding affinity of the core and sheath composite fiber to the natural fibers is attributed to hydrogen bonding between carboxylic groups derived from maleic anhydride and carboxylic groups of acrylic acid or methacrylic acid of the fiber modifier, and hydrogen bonding between carboxylic groups derived from maleic anhydride and hydroxyl groups of the natural fibers.

In addition, the copolymer component used in the fiber modifier of this invention, i.e., the copolymer of ethylene and acrylic acid, the copolymer of ethylene and methacrylic acid, or combinations thereof, has a melting point ranging from 83 to 101° C., which is lower than the melting point of polyethylene (about 130° C.). Therefore, compared to the conventional modifier, such as grafted polyethylene, the fiber modifier according to this invention can be prepared through blending at a relatively low temperature. In addition, grafting reaction which is required in preparation of the conventional modifier and which is relatively unstable and has to be conducted at a relatively high temperature can be omitted. Hence, the manufacture of the fiber modifier of this invention is relatively economical and controllable.

Preparation examples and test examples are given below to illustrate the present invention in further detail, but the scope of the invention should not be limited to these examples.

Preparation of the Fiber Modifier of this Invention

Example A1

A copolymer of ethylene and methacrylic acid (Nucrel 925, melt index: 25 g/10 min, methacrylic acid content 15 wt %, m.p. 92° C., DuPont Company), and a reactant mixture of maleic anhydride (UPC Technology Corp.), methyl ethyl ketone (TT-308, obtained from Lison Chemical company Ltd.) and dicumyl peroxide (0529F, obtained from Lison Chemical Company Ltd.) in a ratio of 4:4:0.2 were fed into an inlet section of a twin-screw extruder (Japan Steel Works Company) at feeding rates of 16 kg/hr and 1.3 kg/hr, respectively. The vacuum level of the twin-screw extruder was set to 0.6 kg/cm$^2$. The rotating speed of the two screws of the twin-screw extruder was set to 250 rpm.

The composition of the copolymer and the reactant mixture was subsequently moved to a heating section of the twin-screw extruder. The heating section was divided into 1$^{st}$ to 13$^{th}$ heating zones from the inlet section to an outlet section. The heating temperatures of the 1$^{st}$ to 13$^{th}$ heating zones were separately set to 92° C., 146° C., 182 t, 185° C., 186° C., 191° C., 195° C., 201° C., 204° C., 205° C., 213° C., and 215° C. Thereafter, the melted composition left the twin-screw extruder under a temperature of 220° C. A blend of maleic anhydride and a copolymer of ethylene and methacrylic acid, i.e., the fiber modifier of the present invention, was obtained. Melt index: 12 g/10 min. Melting point: 91.04° C.

Example A2

The fiber modifier of Example A2 was prepared in a manner similar to that of Example A1, except that the copolymer of ethylene and methacrylic acid used in Example A1 was replaced with another copolymer of ethylene and methacrylic acid (Nucrel 0903, methacrylic acid content 9 wt %, m.p. 101° C., DuPont company). Melting point of the fiber modifier obtained from this Example was 98.65° C.

Example A3

The fiber modifier of Example A3 was prepared in a manner similar to that of Example A1, except that the copolymer of ethylene and methacrylic acid used in Example A1 was replaced with a copolymer of ethylene and acrylic acid (Nucrel 2806, acrylic acid content 18 wt %, m.p. 83° C., DuPont company). Melting point of the fiber modifier obtained from this Example was 82.56° C.

Example A4

The fiber modifier of Example A4 was prepared in a manner similar to that of Example A1, except that the copolymer of ethylene and methacrylic acid used in Example A1 was replaced with another copolymer of ethylene and acrylic acid (ESCOR5200, acrylic acid content 15 wt %, m.p. 88° C., ExxonMobil Chemical Company). Melting point of the fiber modifier obtained from this Example was 89.60° C.

Contact Angle Test

Four starting materials, i.e., the fiber modifier obtained from Example A1, polyethylene (LH-520, m.p.: 130° C., USI Corporation), grafted polyethylene (AMPLIFY GR204, the Dow Chemical Company), and a copolymer of ethylene and methacrylic acid (Nucrel 925, Dupont Company) without maleic anhydride, were separately pressed with a load of 70 kg/cm$^2$ by a hydraulic press in a hot mold at 200° C. for 15 minutes, and then cooled in a cold mold for 25 minutes. Four samples SE1 to SE4, which respectively correspond to the four starting materials in the abovementioned order, were obtained. Each of the samples SE1 to SE4 had an area of 10 cm$^2$ and a thickness of 3 cm. Each of the samples SE1 to SE4 was subjected to a contact angle test using Face contact anglemeter (Model: CA-D, KYONA Interface Science Co., Ltd.) for five times, and the contact angle value of deionized water to each sample at each time of the test was determined. Average of the contact angle values of the five times of the test for each sample is shown in Table 1. The larger the contact angle value of deionized water to the sample, the higher will be the hydrophobicity of the sample. Furthermore, the higher the hydrophobicity of the sample, the poorer will be the thermo-bonding affinity of the sample to natural fibers that are rich in hydroxyl groups.

TABLE 1

| Sample No. | Average of contact angle values |
|---|---|
| SE1 (Example Al) | 50.7 |
| SE2 (Polyethylene) | 88.8 |
| SE3 (Grafted polyethylene) | 71.3 |
| SE4 (Copolymer of ethylene and methacrylic acid without maleic anhydride) | 76.7 |

TABLE 1-continued

| Sample No. | Average of contact angle values |
|---|---|

According to the results shown in Table 1, the contact angle value of deionized water to SE1 is much smaller than those of deionized water to SE2 to SE4. This demonstrates that compared to conventional modifiers, i.e., grafted polyethylene, and copolymer of ethylene and methacrylic acid without maleic anhydride, the fiber modifier obtained from Example A1, i.e., the fiber modifier according to this invention, has a more excellent thermo-bonding affinity to the natural fibers. Thus, when the fiber modifier of this invention is applied to the manufacture of a sheath component of a core and sheath composite fiber, the core and sheath composite fiber thus made can be expected to have improved thermo-bonding affinity.

Preparation of a Fiber Composition for a Sheath Component of a Core and Sheath Composite Fiber

Examples B1 to B4

Sheath components of the fiber composition of Examples B1 to B4 for use in a core and sheath composite fiber were prepared by mixing the fiber modifier obtained from Example A1 with polyethylene indifferent ratios as shown in Table 2 below. The fiber modifier obtained from Example A1 and polyethylene were pre-heated prior to the mixing operation at temperatures of 50° C. and 80° C., respectively. Then, the mixtures thus made were separately granulated in an extruder and then melt-spun and drawn into the corresponding sheath components SC1 to SC4 under the conditions (1) and (4) to (11) summarized in Table 5 below.

Thermo-Bonding Affinity Test

The sheath components SC1 to SC4 obtained from Examples B1 to B4 were separately placed on a cotton fabric (yarn count: 30 (100% cotton)) fixed on a needle plate, and subsequently subjected to thermosetting treatment together in an oven (model no. R-3, Labortex Co., Ltd.). The thermosetting treatment was conducted at a melting temperature of 135° C. for 3 minutes. Thereafter, the thermo-bonding affinity of each of the sheath components SC1 to SC4 to the cotton fabric was observed.

The control group was prepared in a manner similar to that of Examples B1 to 54 except that polyethylene was not mixed with the fiber modifier of Example A1. The thermo-bonding affinity of the control group to the cotton fabric was likewise observed. Results of the thermo-bonding affinity test are shown in Table 2 below.

TABLE 2

| Sheath component | Polyethylene content (wt %) | Fiber modifier content (wt %) | Thermo-bonding affinity |
|---|---|---|---|
| SC1 | 88 | 12 | Good |
| SC2 | 89 | 11 | Good |
| SC3 | 93 | 7 | Good |
| SC4 | 94 | 6 | Good |
| Control group | 100 | — | Poor |
| Melting temperature | | 135° C. | |

According to the results shown in Table 2, addition of the fiber modifier of this invention will improve the thermo-bonding affinity of the sheath component to the cotton fabric (i.e., the natural fibers).

Examples B5 to B7

Sheath components SC5 to SC7 of Examples B5 to B7 were prepared in a manner similar to that of Example B2 (i.e., the weight ratio for polyethylene to the fiber modifier was 89:11), except that the fiber modifiers used in Examples B5 to B7 were separately obtained from Examples A2 to A4.

Comparison Between Sheath Component SC2 and SC5 to SC7, and Control Group in Thermo-Bonding Affinity to Natural Fibers Sheath components SC5 to SC7 were subjected to the thereto-bonding affinity test in a manner similar to that of the sheath component SC2. Results of the thermo-bonding affinity test obtained from the sheath components SC2, SC5 to SC7, and the control group, and acrylic acid or methacrylic acid content of the fiber modifier used therein are summarized in Table 3 for convenience of comparison.

TABLE 3

| Sheath component | Acrylic acid or methacrylic acid content of the fiber modifier | Thermo-bonding affinity |
|---|---|---|
| SC2 | 15 wt % of methacrylic acid | Very good |
| SC5 | 9 wt % of methacrylic acid | Good |
| SC6 | 18 wt % of acrylic acid | Very good |
| SC7 | 15 wt % of acrylic acid | Good |
| Control group | — | Poor |
| Melting temperature | 135° C. | |

According to the results shown in Table 3, addition of the fiber modifier of this invention will improve the thermo-bonding affinity of the sheath component to the cotton fabric (i.e., the natural fibers). In addition, the results also demonstrate that the higher the acrylic or methacrylic content of the fiber modifier, the better will be the thermo-bending affinity of the sheath component to the natural fibers.

Thermo-Bonding Affinity Test Under a Lower Melting Temperature

Sheath components SC2, SC5 to SC7 and the control group were subjected to the thermo-bonding affinity test in a manner similar to the abovementioned thermo-bonding affinity test, except that the melting temperature of the oven was lowered to 125° C. Results of the thermo-bonding affinity test obtained from the sheath components SC2, SC5 to SC7, and the control group, and acrylic acid or methacrylic acid content of the fiber modifier used therein are shown in Table 4.

TABLE 4

| Sheath component | Acrylic acid or methacrylic acid content of the fiber modifier | Thermo-bonding affinity |
|---|---|---|
| SC2 | 15 wt % of methacrylic acid | Very good |
| SC5 | 9 wt % of methacrylic acid | Good |
| SC6 | 18 wt % of acrylic acid | Very good |
| SC7 | 15 wt % of acrylic acid | Good |
| Control group | — | Poor |
| Melting temperature | 125° C. | |

The results shown in Table 4 demonstrate that, at a lower melting temperature, addition of the fiber modifier according to this invention is still able to improve the thermo-bonding affinity of the sheath component to the cotton fabric. In other words, by addition of the fiber modifier of this invention, production of the sheath component of the core and sheath composite fiber can be conducted in a power-saving way and at an economical cost.

Preparation of a Core and Sheath Composite Fiber Including a Sheath Component of the Fiber Composition Example C1

A core and sheath composite fiber was prepared by melt-spinning and drawing techniques. Raw material of the sheath component included the fiber modifier obtained from Example A1 and polyethylene. The fiber modifier of Example A1 and polyethylene were pre-heated to temperatures of 50° C. and 80° C., respectively, and mixed in the same weight ratio as that of Example B2, i.e., 88:11. Raw material of the core component included propylene (6231F, m.p.: 166.1° C., Taiwan Polyplene Co., Ltd.), which was pre-heated to a temperature of 80° C. The raw material of the sheath component and the raw material of the core component were separately fed into extruders, temperatures of heating zones of which were set according to the conditions (1) and (2) summarized in Table 5 below, so as to form the sheath and core components. The sheath and core components were subsequently fed into a melt-spinning machine (available from Fleissner GmbH, Germany) and a drawing machine (available from Oerlikon Neumag GmbH, Germany) in a weight ratio of 65:35 so as to form the core and sheath composite fiber having a size of 1.5 d×38 mm. The operational conditions of the melt-spinning and drawing machines were set according to the conditions (3) to (7) and (8) to (11) summarized in Table 5 below, respectively.

TABLE 5

| Conditions | |
|---|---|
| (1) Temperatures set sequentially in five heating zones of the extruder for formation of the sheath component | room temperature, 200° C., 240° C., 240° C., 240° C. |
| (2) Temperatures set sequentially in five heating zones of the extruder for formation of the core component | 260° C., 260° C., 260° C., 260° C., 260° C. |
| (3) Weight ratio of the sheath component to the core component | 65%/35% |
| (4) Temperature of heat transfer fluid (Therminol ®) | 260° C. |
| (5) Spinneret type | 600H (for sheath and core components) |
| (6) Oil peak up percentage (OPU) | 0.3 |
| (7) Take-up speed (m/min) | 1350 |
| (8) Draw ratio | 4.2 |
| (9) Drawing temperature | 60° C. to 85° C. |
| (10) Thermosetting temperature | 85° C. to 115° C. |
| (11) Drying temperature of filament bundles (Two dryer system) | 113° C. |

Comparative Example 1

A core and sheath composite fiber was made in a manner similar to that of Example C1, except that the sheath component was made only from polyethylene, and that temperatures set sequentially in five heating zones of the extruder for formation of the sheath component were 200° C., 200° C., 240° C., 240° C. and 240° C.

Comparative Example 2

A core and sheath composite fiber was made in a manner similar to that of Example C1, except that the sheath component was made from 89 wt % of polyethylene and 11 wt % of a conventional modifier (Amplify gr204, The Dow Chemical Company), that the conventional modifier was pre-heated to a temperature of 80° C., and that temperatures set sequentially in five heating zones for formation of the sheath component were 200° C., 200° C., 235° C., 240° C. and 240° C.

Comparative Example 3

Commercially available modified polyethylene/polypropylene composite fiber (the CHISSO Corporation) was used as the core and sheath composite fiber of Comparative Example 3.

Example C2

A core and sheath composite fiber was prepared by melt-spinning and drawing techniques. Raw material of the sheath component included 8 wt % of the fiber modifier obtained from Example A1, and 92 wt % of polyethylene. Raw material of the core component included polyester (CSS-910, m.p.: 255° C., Far Eastern Textile Ltd., Taiwan), which was pre-heated to a temperature of 140° C. The raw material of the sheath component and the raw material of the core component were separately fed into extruders, temperatures of heating zones of which were set according to the conditions (1) and (2) summarized in Table 6 below, so as to form the sheath and core components. The sheath and core components were subsequently fed into a melt-spinning machine (available from Fleissner GmbH, Germany) and a drawing machine (available from Oerlikon Neumag GmbH, Germany) in a weight ratio of 55:45 so as to form the core and sheath composite fiber having a size of 2.0 d×38 mm. The operational conditions of the melt-spinning and drawing machines were set according to the conditions (3) to (7) and (8) to (11) summarized in Table 6 below, respectively.

TABLE 6

| Conditions | |
|---|---|
| (1) Temperatures set sequentially in five heating zones of the extruder for formation of the sheath component | room temperature, 200° C., 240° C., 240° C., 240° C. |
| (2) Temperatures set sequentially in five heating zones of the extruder for formation of the core component | 295° C., 300° C., 300° C., 305° C., 305° C. |
| (3) Weight ratio of the sheath component to the core component | 55%/45% |
| (4) Temperature of heat transfer fluid (Therminol ®) | 260° C. (for sheath component)/280° C. (for core component) |
| (5) Spinneret type | 600H (for sheath and core components) |
| (6) Oil peak up percentage (OPU) | 0.3 |
| (7) Take-up speed (m/min) | 1350 |
| (8) Draw ratio | 3.1 |
| (9) Drawing temperature | 50° C. to 90° C. |
| (10) Thermosetting temperature | 65° C. to 115° C. |
| (11) Drying temperature of filament bundles (Two dryer system) | 113° C. |

Comparative Example 4

A core and sheath composite fiber was made in a manner similar to that of Example C2, except that the sheath component was made only from polyethylene, and that temperatures set sequentially in five heating zones of the extruder for formation of the sheath component were 250° C., 250° C., 255° C., 255° C. and 255° C.

Comparative Example 5

A core and sheath composite fiber was made in a manner similar to that of Example C2, except that the sheath component was made from 90 wt % of polyethylene and 10 wt % of a conventional modifier (Amplify GR-204, The Dow Chemical company) and that temperatures set sequentially in five heating zones for formation of the sheath component were 250° C., 250° C., 255° C., 255° C. and 255° C., respectively.

As stated in Example C1 and Comparative Examples 1 and 2, by virtue of addition of the fiber modifier according to this invention, the temperatures set sequentially in five heating zones for formation of the sheath component can start from room temperature. In addition, as stated in Example C1 and Comparative Example 2, the pre-heating temperature required for the fiber modifier of this invention was 50° C., while the pre-heating temperature required for the conventional modifier was 80° C. These facts demonstrate that production of the sheath component of the core and sheath composite fiber can be conducted in a power-saving way and at an economical cost through addition of the fiber modifier of this invention.

Similar results and observations can be obtained from Example C2 and Comparative Examples 4 and 5.

Evaluation of Physical Properties of Core and Sheath Composite Fiber

Results of the physical properties of the core and sheath composites fibers obtained from Example C1 and Comparative Examples 1 to 3 are shown in Table 7.

TABLE 7

| | Example C1 | Comparative Example 1 | Comparative Example 2 | Comparative Example 3 |
|---|---|---|---|---|
| Denier(d) | 1.61 | 1.60 | 1.70 | 1.65 |
| Length(mm) | 38.3 | 38.0 | 38.0 | 38.6 |
| Number of crimp (CN) | 13.3 | 12.7 | 14.3 | 13.8 |
| Degree of crimp (CD, %) | 12.2 | 12.6 | 14.5 | 15.0 |
| Crimp elasticity (CS, %) | 71.7 | 72.4 | 80.2 | 70.3 |
| Hot air shrinkage (HAS, %) ≦ 4.5% | 1.4 | 1.2 | 2.5 | 3.1 |
| Oil peak up percentage (OPU) | 0.3 | 0.3 | 0.3 | — |

In addition, results of the physical properties of the core and sheath composites fibers obtained from Example C2 and Comparative Examples 4 and 5 are shown in Table 8.

TABLE 8

| | Example C2 | Comparative Example 4 | Comparative Example 5 |
|---|---|---|---|
| Denier(d) | 2.76 | 2.4 | 2.20 |
| Length(mm) | 40.3 | 39.0 | 39.0 |
| Number of crimp (CN) | 13.3 | 12.0 | 13.0 |
| Degree of crimp (CD, %) | 18.3 | 15.5 | 14.5 |
| Crimp elasticity (CS, %) | 82.2 | 80.0 | — |

TABLE 8-continued

| | Example C2 | Comparative Example 4 | Comparative Example 5 |
|---|---|---|---|
| Hot air shrinkage (HAS, %) ≦ 4.5% | 1.1 | 1.2 | 1.5 |
| Oil peak up percentage (OPU) | 0.3 | 0.3 | 0.3 |

According to the results shown in Tables 7 and 8, addition of the fiber modifier of this invention has no adverse effect on the physical properties of the core and sheath composite fiber.

Thermo-Bonding Test

Example D1

20 g of the core and sheath composite fibers obtained from Example C1 (30 wt %) and Rayon fibers (70 wt %, 2 d×38 mm, Vicunha Textil SA Company) were carded twice in a carding machine. The carded cotton mesh thus made was heated in an oven at 145° C. for 3 minutes so as to form a non-woven fabric web having a basis weight of 100 g/m$^2$. The non-woven fabric web was cut into specimens (FD1), each of which has a size of 30 cm×5 cm.

Comparative Examples 6 to 8

Specimens of the non-woven fabric web of Comparative Examples 6 to 8 (CF6 to CF8) were made in a manner similar to Example D1, except that the core and sheath composite fibers were separately obtained from Comparative Examples 1 to 3.

Breaking strength and elongation of the specimens obtained from Example D1 (FD1) and Comparative Examples 6 to 8 (CF6 to CF8) were determined by a tensile strength test machine (INSTRON-4301) and results are shown in Table 9.

TABLE 9

| | Breaking strength (kg) | Elongation (%) |
|---|---|---|
| FD1 | 6.0 | 15.3 |
| CF6 | 2.2 | 13.1 |
| CF7 | 5.3 | 11.2 |
| CF8 | 5.2 | 18.2 |

According to the results shown in Table 9, specimens of Example D1 (FD1) have a breaking strength almost three times that of specimens of Comparative Example 6 (CF6). This demonstrates that addition of the fiber modifier of this invention into the sheath component will greatly enhance the thermo-bonding affinity of the core and sheath composite fiber to the natural fiber.

In addition, specimens of Example D1 (FD1) have a breaking strength comparable with or even better than those of the specimens of Comparative Examples 7 and B (CF7 and CF8). This demonstrates that the fiber modifier according to this invention can achieve the same or even better level of thermo-bonding improvement than that of the conventional modifier containing grafted polyethylene.

Example D2

20 g of the core and sheath composite fibers obtained from Example C2 (30 wt %) and Rayon fibers (70 wt %, 2 d×38 mm, Vicunha Textil SA Company) were carded twice in a carding machine. The carded cotton mesh thus made was heated in an oven at 145° C. for 3 minutes so as to form a non-woven fabric web having a basis weight of 100 g/m$^2$. The non-woven fabric web was cut into specimens (FD2), each of which has a size of 30 cm×5 cm.

Comparative Examples 9 and 10

Specimens of the non-woven fabric web of Comparative Examples 9 and 10 (CF9 and CF10) were made in a manner similar to Example D2, except that the core and sheath composite fibers were separately obtained from Comparative Examples 4 and 5.

Breaking strength and elongation of the specimens obtained from Example D2 (FD2) and Comparative Examples 9 and 10 (CF9 and CF10) were determined by a tensile strength test machine (INSTRON-4301) and results are shown in Table 10.

TABLE 10

| | Breaking strength (kg) | Elongation (%) |
|---|---|---|
| FD2 | 4.0 | 13.2 |
| CF9 | 0.5 | 21.6 |
| CF10 | 3.8 | 15.6 |

According to the results shown in Table 10, specimens of Example D2 (FD2) have a breaking strength almost eight times as high as that of specimens of Comparative Example 9 (CF9). This demonstrates that addition of the fiber modifier of this invention into the sheath component will greatly enhance the thermo-bonding affinity of the core and sheath composite fiber to the natural fiber.

In addition, specimens of Example D2 (FD2) have a breaking strength comparable with or even better than those of the specimens of Comparative Example 10 (CF10). This demonstrates that the fiber modifier according to this invention can achieve the same or even better level of thereto-bonding improvement than that of the conventional modifier containing grafted polyethylene.

In view of the foregoing, addition of the fiber modifier of this invention in the fiber composition will enhance the thermo-bonding affinity of the composite fiber thus made to the natural fiber. Besides, addition of the fiber modifier of this invention in the fiber composition will enable the sheath component of the composite fiber to be prepared at a lower temperature. Hence, production cost of the composite fiber can be decreased.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. A fiber composition suitable for producing a sheath component of a core and sheath composite fiber, comprising polyethylene and a fiber modifier including a blend of maleic anhydride and a copolymer component selected from the group consisting of a copolymer of ethylene and acrylic acid, a copolymer of ethylene and methacrylic acid, and combinations thereof, the weight ratio of polyethylene to said fiber modifier ranging from 95:5 to 88:12.

2. The fiber composition of claim 1, characterized in that the weight ratio of polyethylene to said fiber modifier ranges from 94:6 to 89:11.

3. The fiber composition of claim 1, characterized in that the content of maleic anhydride in said blend ranges from 3% to 4% by weight.

4. The fiber composition of claim 1, characterized in that said copolymer component is the copolymer of ethylene and acrylic acid, and wherein the weight ratio of ethylene to acrylic acid in said copolymer component ranges from 91:9 to 82:18.

5. The fiber composition of claim 4, characterized in that the weight ratio of ethylene to acrylic acid in said copolymer component ranges from 90:10 to 85:15.

6. The fiber composition of claim 1, characterized in that said copolymer component is the copolymer of ethylene and methacrylic acid, and wherein the weight ratio of ethylene to methacrylic acid in said copolymer component ranges from 96:4 to 85:15.

7. The fiber composition of claim 6, characterized in that the weight ratio of ethylene to methacrylic acid in said copolymer component ranges from 91:9 to 85:15.

8. The fiber composition of claim 1, characterized in that the melting point of said fiber composition ranges from 88° C. to 130° C.

* * * * *